US007225638B2

(12) United States Patent
Loeff et al.

(10) Patent No.: US 7,225,638 B2
(45) Date of Patent: Jun. 5, 2007

(54) CONVERTIBLE JEWELRY MOUNTING

(75) Inventors: Sharon Loeff, Scottsdale, AZ (US); Thomas Loeff, Scottsdale, AZ (US)

(73) Assignee: Sharon Loeff Designs, LLC

( * ) Notice: Subject to any disclaimer, the term of this patent is extended or adjusted under 35 U.S.C. 154(b) by 15 days.

(21) Appl. No.: 11/080,498

(22) Filed: Mar. 16, 2005

(65) Prior Publication Data

US 2006/0207288 A1 Sep. 21, 2006

(51) Int. Cl.
*A44C 7/00* (2006.01)

(52) U.S. Cl. ..... 63/12; 63/13; 63/14.1; 24/705

(58) Field of Classification Search ..... 63/12, 63/13, 41, 40, 18, 19, 33, 21–23, 1.16, 1.17; 24/705, 574.1, 89
See application file for complete search history.

(56) References Cited

U.S. PATENT DOCUMENTS 2,050,804 A * 8/1936 Philippe ..... 63/20
2,227,184 A * 12/1940 Goetz ..... 63/20
4,377,939 A * 3/1983 Reinsdorf ..... 63/3

* cited by examiner

*Primary Examiner*—Jack W. Lavinder
(74) *Attorney, Agent, or Firm*—H. Jay Spiegel

(57) ABSTRACT

A jewelry mounting includes a base having front and rear surfaces. The front surface is provided with means permitting the mounting of an article of jewelry or other ornament usable on an earring or pendant. The rear surface includes a pivotable mounting for an ear post. The base also includes side walls to which are pivotably mounted two hoops. When the device is being used as an earring, the hoops lie in opposite directions to one another coplanar with the base. When the device is being used as a jewelry pendant, the hoops are pivoted orthogonal to the base and, in that orientation, comprise bails through which a jewelry chain may be threaded. The piece of jewelry or ornament may include a rear surface including a slot that receives the ear post when the ear post is pivoted down. The slot frictionally retains an end of the ear post to retain the ear post and hoops in the position at which the device may be used as a pendant. In one embodiment of the present invention, the hoops are manually moved from one orientation to another. In another embodiment, torsion springs are provided to bias the hoops from a position at which they lie in a common plane toward a position at which they lie in parallel planes. A latching mechanism is provided for each hoop to lock them in the position at which they lie in a common plane and the inventive device is used as an earring.

28 Claims, 12 Drawing Sheets

CONVERTIBLE JEWELRY MOUNTING

BACKGROUND OF THE INVENTION

The present invention relates to embodiments of a convertible jewelry mounting.

As jewelry becomes more and more expensive, a need has developed for enhanced versatility in jewelry mountings so that, for example, an earring may also be used as a necklace pendant. Were a mounting available to accomplish this feat, a consumer could purchase one piece of jewelry that could be used for two separate purposes.

The following prior art is known to Applicant:

U.S. Pat. No. 4,276,757 to Boening discloses a jewelry support including a pin designed to support an article of jewelry as a brooch as well as an opening and a hook with a bail that may receive a chain to allow support of the article of jewelry as a pendant. The present invention differs from the teachings of Boening as contemplating an earring convertible for use as a pendant and wherein the post and bails thereof are pivotable to alternate orientations based upon the particular use to which the article of jewelry is being put.

U.S. Pat. No. 5,044,175 to Razza discloses a convertible brooch in which a pair of earring elements may be connected together to create a brooch. The present invention differs from the teachings of Razza as contemplating an earring convertible for use as a pendant and wherein the post and bails thereof are pivotable to alternate orientations based upon the particular use to which the article of jewelry is being put.

U.S. Pat. No. 5,170,641 to DiDomenico discloses a pin adaptor for pierced earrings. The adaptor, in essence, bends the earring post at a right angle downwardly so that an article of clothing may be penetrated to support the earring as a pin. The present invention differs from the teachings of DiDomenico as contemplating an earring convertible for use as a pendant and wherein the post and bails thereof are pivotable to alternate orientations based upon the particular use to which the article of jewelry is being put.

U.S. Pat. No. 5,245,844 to Panzer discloses a pin to pendant converter in which a pin includes a ring usable as a bail to receive a necklace chain therethrough. The present invention differs from the teachings of Panzer as contemplating an earring convertible for use as a pendant and wherein the post and bails thereof are pivotable to alternate orientations based upon the particular use to which the article of jewelry is being put.

U.S. Pat. No. 5,353,608 to Berkowitz discloses a multi-use jewelry piece which includes a setting for holding first and second display objects and a pair of hoops connected to the setting that may be manipulated so that the setting can be used as an earring or pendant. The present invention differs from the teachings of Berkowitz as contemplating an earring convertible for use as a pendant and wherein the post and bails thereof are pivotable to alternate orientations based upon the particular use to which the article of jewelry is being put.

SUMMARY OF THE INVENTION

The present invention relates to embodiments of a convertible jewelry mounting. The present invention includes the following interrelated objects, aspects and features:

(1) In a first embodiment, the inventive jewelry mounting includes a base having front and rear surfaces. The front surface is provided with means permitting the mounting of an article of jewelry or other ornament usable on an earring or pendant. The rear surface includes a pivotable mounting for an ear post.

(2) The base also includes side walls to which are pivotably mounted two hoops. When the inventive device is being used as an earring, the hoops lie in opposite directions to one another coplanar with the base. When the inventive device is being used as a jewelry pendant, the hoops are pivoted orthogonal to the base and parallel to one another. In that orientation, they comprise bails through which a jewelry chain may be threaded.

(3) Each of the hoops has a tab extending laterally from the hoop structure. From the orientation of parts of the inventive device when it is being used as an earring, the hoops are pivoted upwardly so that they lie adjacent to one another and in parallel configuration, whereupon the ear post is pivoted downwardly. The ear post also has an elongated lateral tab that overlies the tabs of the hoops to hold the hoops in the position at which they are usable as bails to receive a jewelry chain therethrough. A disk on the ear post protects the ear from abrasion from the lateral tab.

(4) The piece of jewelry or ornament mounted on the front surface of the base may include a rear surface that includes a slot that receives the end of the ear post when the ear post is pivoted down and its elongated lateral tab overlies the lateral tabs of the hoops. The slot frictionally retains an end of the ear post to retain the ear post and hoops in the position at which the inventive device may be used as a pendant.

(5) In a second embodiment, torsion springs and latches are provided on each of the bails. With the bails in the position at which the inventive device is being used as an earring, the latches are rotated to a position that retains the bails in parallel planes. In those positions, the torsion springs are biased such that they are trying to rotate the bails to positions at which they lie in parallel planes.

(6) When it is desired to utilize the inventive device as a pendant, the latches are rotated to release the interaction between the latches and the base, whereupon the torsion springs are operative to cause the bails to rotate upwardly until they lie in parallel planes so that a jewelry necklace can be threaded therethrough.

(7) In the position of the bails in which the device functions as a pendant, the post is pivoted toward the base and includes a T-shaped end that underlies undersurfaces of the bails in their parallel positions to thereby lock the bails and preclude them from pivoting against the force of the respective torsion springs.

(8) When it is desired to pivot the bails to lie in a common plane, the post must first be pivoted so that its T-shaped end releases the undersurfaces of the bails and permits them to be pivoted to the position in which they lie in a common plane. In that position, the torsion springs bias the bails to the position at which they are usable to receive a jewelry chain. As such, when pivoted to lie in a common plane, the latches are then pivoted to lock the bails in that position.

As such, it is a first object of the present invention to provide embodiments of a convertible jewelry mounting.

It is a further object of the present invention to provide such a device in which, in one orientation thereof, it may be used as an earring.

It is a still further object of the present invention to provide such a device in which, in a second orientation, it may be used as a pendant.

It is a still further object of the present invention to provide such a device wherein two hoops are pivoted to one co-planar orientation when the device is being used as an earring and to another parallel orientation when the device is being used as a pendant.

It is a still further object of the present invention to provide such a device in which an ear post is pivoted perpendicularly with respect to a base on which it is mounted when the device is being used as an earring.

It is a yet further object of the present invention to provide such a device in which the ear post thereof is pivoted parallel with the base when the device is being used as a pendant.

It is a still further object of the present invention, in an alternative embodiment thereof, to provide bails spring biased to a position at which they lie in parallel planes and are usable to receive a jewelry chain therethrough.

It is a still further object of the present invention to provide such a device in which latches are provided to retain the bails lying in a common plane for use as an earring.

It is a still further object of the present invention to provide such a device in which the ear post thereof is pivoted when the bails are lying in parallel planes to lock the bails in that orientation.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
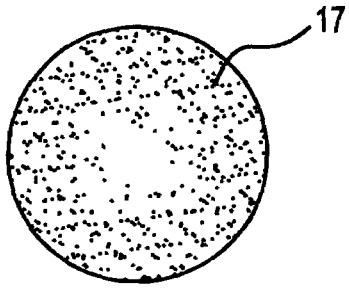
FIG. 1 shows a front view of a first embodiment of an article of jewelry mounted on a base in accordance with the teachings of the present invention.

With reference, first, to FIGS. 1–6, a first embodiment of the present invention is generally designated by the reference numeral 10 and includes an article of jewelry or ornamentation generally designated by the reference numeral 11 and including, in the example shown, a generally circular hoop 13 with ornaments 15 spaced about its periphery and a large ornament or piece of jewelry 17 (FIG. 1, in particular) attached on a forward surface of the ring 13.

Figure 2:
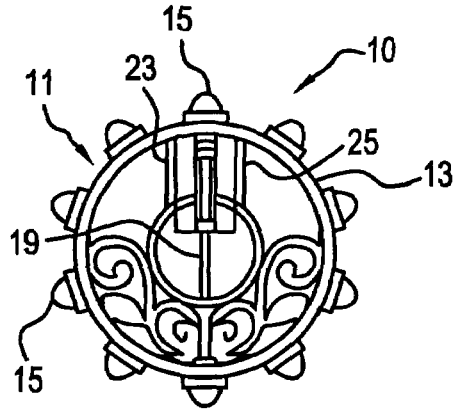
FIG. 2 shows a rear view of the article of jewelry of FIG. 1, but including additional peripheral ornamentation.
Figure 3:
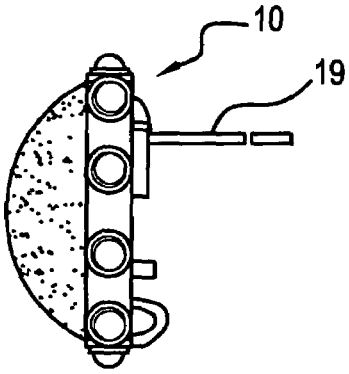
FIG. 3 shows a side view of the article of jewelry of FIG. 2 with the ear post thereof in the position for use as an earring.
Figure 4:
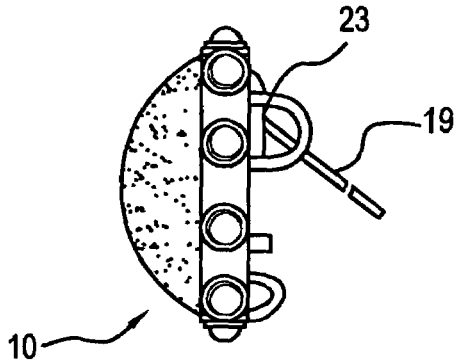
FIG. 4 shows a view similar to that of FIG. 3, but with the ear post moving toward a downward locked position and the hoops used as bails erected.
Figure 6:
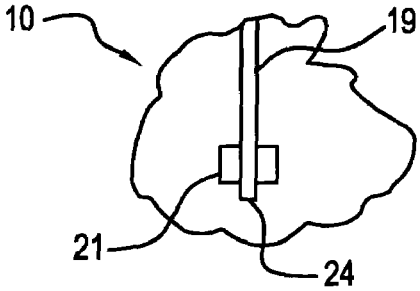
FIG. 6 shows an enlarged rear view showing the post received in a locking slot.

As seen in FIGS. 3 and 4, a post 19 is attached to the ring 13 in a manner to be described in greater detail hereinafter, and is pivotable from the position shown in FIG. 3 to the position shown in FIGS. 2 and 6. As shown in FIG. 6, a slot 21 is provided on the article 11 to retain the post 19 in the position shown in FIG. 2.

Figure 5:
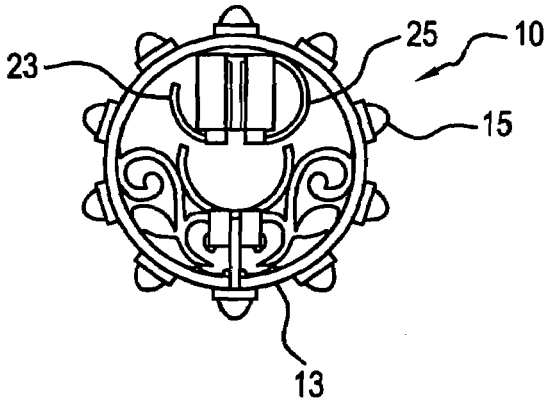
FIG. 5 shows a view similar to that of FIG. 2, but with the ear post in the same position as shown in FIG. 3.

As shown in FIG. 5, two hoops or bails 23 and 25 are pivotably mounted on the article 11 and may pivot from the position shown in FIG. 5 in which they lie in a common plane to the position in FIG. 2 in which they lie in parallel planes. The position of the hoops shown in FIG. 2 is also shown in FIG. 4 and, in that position, with the post 19 fully to the position shown in FIG. 2, the hoops 23, 25 act as bails and may receive a jewelry chain (not shown) so that the device 10 may be used as a pendant. In the position of the post 19 shown in FIG. 3, the device 10 may be used as an earring.

Reference is now made to FIGS. 7–11 so that a more detailed explanation of the operation of the inventive device may be provided.

With reference to FIGS. 7–11, the inventive mechanism is generally designated by the reference numeral 20 and includes the above-described ear post 19 and hoops or bails 23 and 25. These items are mounted on a base 31 as explained in greater detail below.

With reference to FIGS. 7–11, the base 31 includes a rear surface 33 (FIGS. 7, 9 and 10) and a front surface 35 (FIG. 11) to which the article 11 is suitably affixed.

Figure 7:
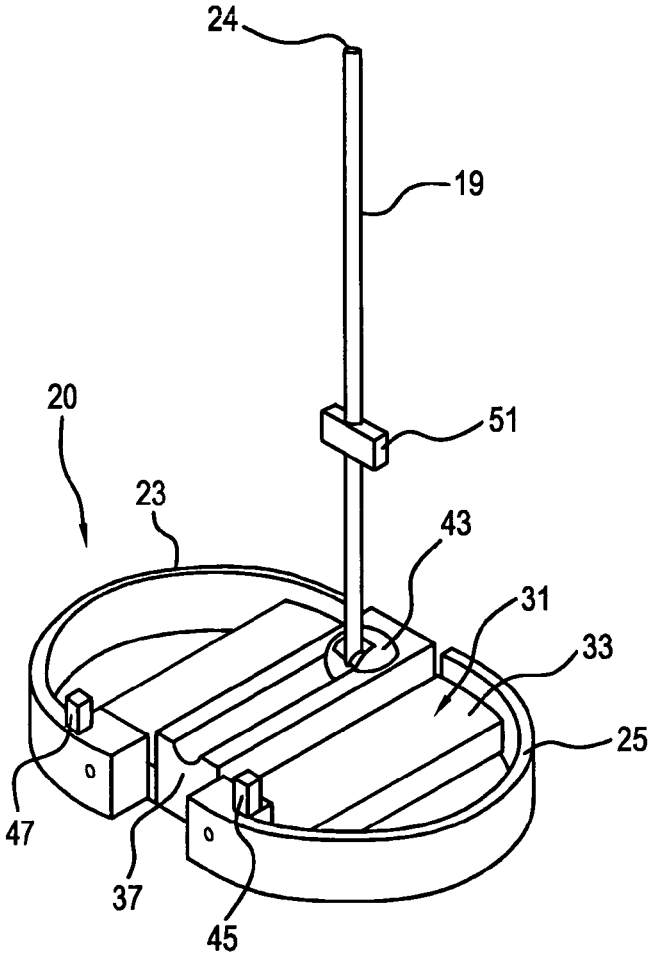
FIG. 7 shows a perspective view of the inventive device in the same orientation of parts as shown in FIG. 3.
Figure 8:
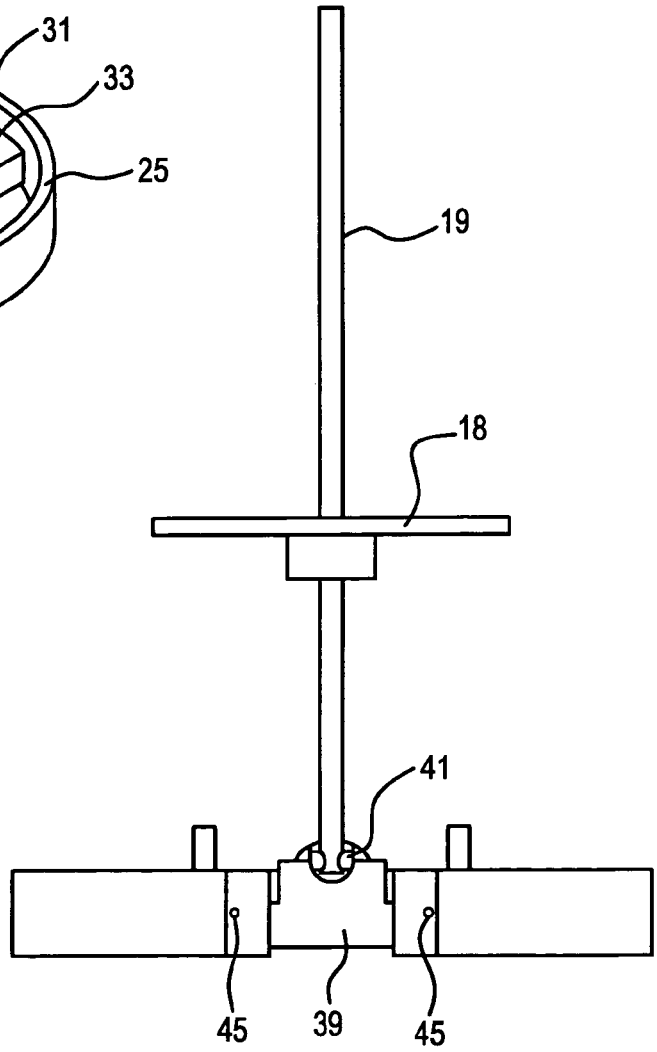
FIG. 8 shows a front view of the device in the orientation shown in FIG. 7.

The base includes opposed sides 37 (FIG. 7) and 39 (FIG. 8). With reference to FIGS. 7 and 8, the post 19 includes a cross member 41 received within recesses (not shown) in a fixture 43 (FIG. 7) mounted in the base 31 so that the post 19 may pivot from the position shown in FIG. 7 to the position shown in FIGS. 10 and 11. As shown in FIG. 8, a soft disk 18 is located above the tab 51 to protect the user's ear from irritation that would occur if the tab engaged the ear (not shown).

Figure 9:
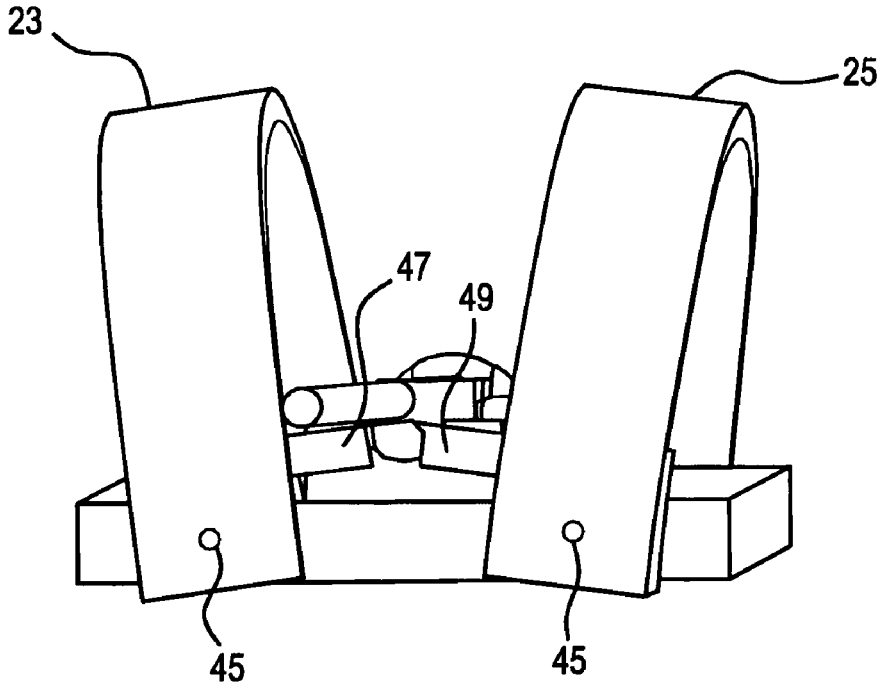
FIG. 9 shows a perspective view of the inventive device in a similar orientation to that which is shown in FIG. 4.
Figure 10:
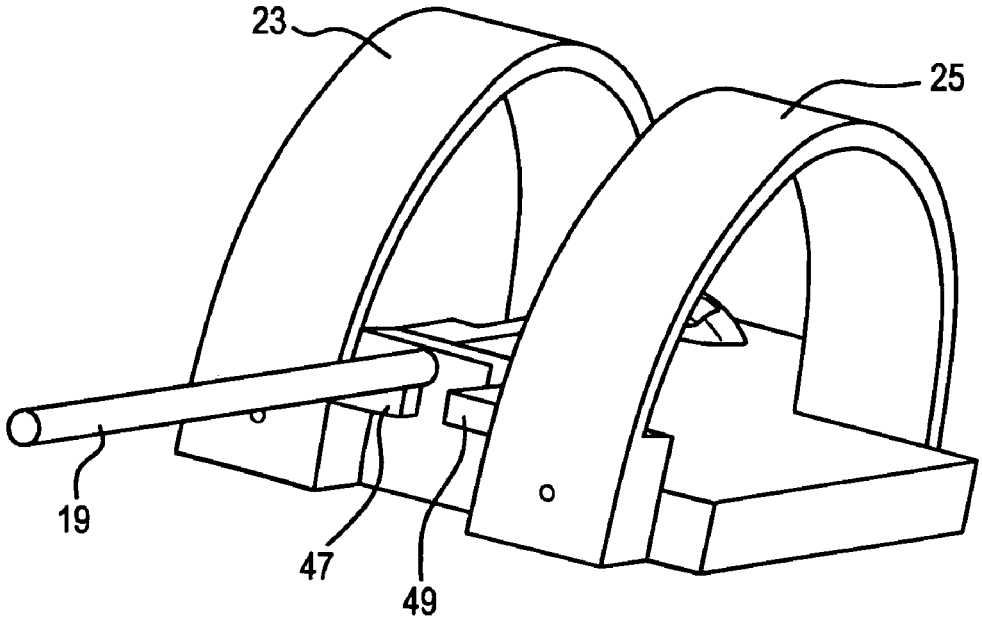
FIG. 10 shows a perspective view of the inventive device in the orientation of parts shown in FIG. 2.
Figure 11:
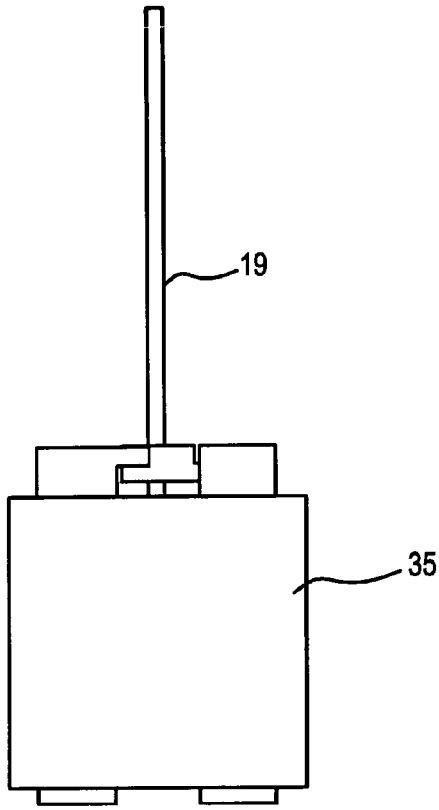
FIG. 11 shows a bottom view of the inventive device in the orientation of parts shown in FIG. 2.

With further reference to FIGS. 7–9, the hoops 23 and 25 are pivotably mounted on the side walls 37 and 39 of the base 31. For this purpose, pins 45 extend through the hoops 23, 25 and into openings (not shown) in the side walls 37, 39 of the base 31. As shown, the hoops or bails 23, 25 can pivot from the position shown in FIGS. 7 and 8 in which they lie in a common plane to the position shown in FIG. 10 in which they lie in parallel planes. As explained above, when the inventive device 10 is being used as an earring, the hoops 23, 25 are positioned as shown in FIGS. 7 and 8 and act as bails. When the inventive device 10 is being used as a pendant, the hoops or bails 23 and 25 are pivoted to the position shown in FIG. 10.

As clearly shown in FIGS. 7 and 8, the hoop or bail 23 has a lateral tab 47 and the hoop or bail 25 has a lateral tab 49. In the orientation of the hoops or bails 23 and 25 shown in FIG. 10, the tabs 47 and 49 are aligned with one another.

With reference back to FIGS. 7 and 8, the post 19 includes a further tab 51. As best seen with reference to FIGS. 9 and 10, when the hoops or bails 23, 25 are pivoted to the position shown in FIG. 10, and the post 19 is pivoted downwardly as also shown therein, the tab 51 of the post 19 overlies the tabs 47 and 49 to hold the hoops 23, 25 in the position shown in FIG. 10. In that orientation, with reference to FIG. 6, the end 24 of the post 19 enters the slot 21 to releasably lock the post 19 in the position shown in FIG. 10. This locking effect assists in retaining the hoops or bails 23, 25 in the position shown in FIG. 10.

Thus, as should be understood, when it is desired to use the device 10 as an earring, the position of the parts thereof is as shown in FIGS. 3, 5, 7 and 8. When it is desired to use the inventive device 10 as a jewelry pendant, the position of parts is as shown in FIGS. 2, 6, 10 and 11.

Given the small size of common jewelry components and the difficulty most people would encounter in holding the hoops or bails 23, 25 upright while trying to thread a chain (not shown) of a necklace through the bail openings, the locking of the post 19 holds the bails in upstanding position to permit a person even with limited dexterity and visual acuity to thread the chain through the bails quickly and easily.

The inventive device disclosed hereinabove may be suitably installed on virtually any earring or necklace component provided there is sufficient room to install it as shown, for example, in FIGS. 1–6.

The component parts making up the present invention may easily be mass produced using base and/or precious metals and may be installed on various jewelry items during the final assembly process. The components making up the present invention may easily be manufactured using standard manufacturing processes including casting and stamping.

With reference now to FIGS. 12–24, an explanation of the structure and function of a second embodiment of the present invention will be provided.

Figure 12:
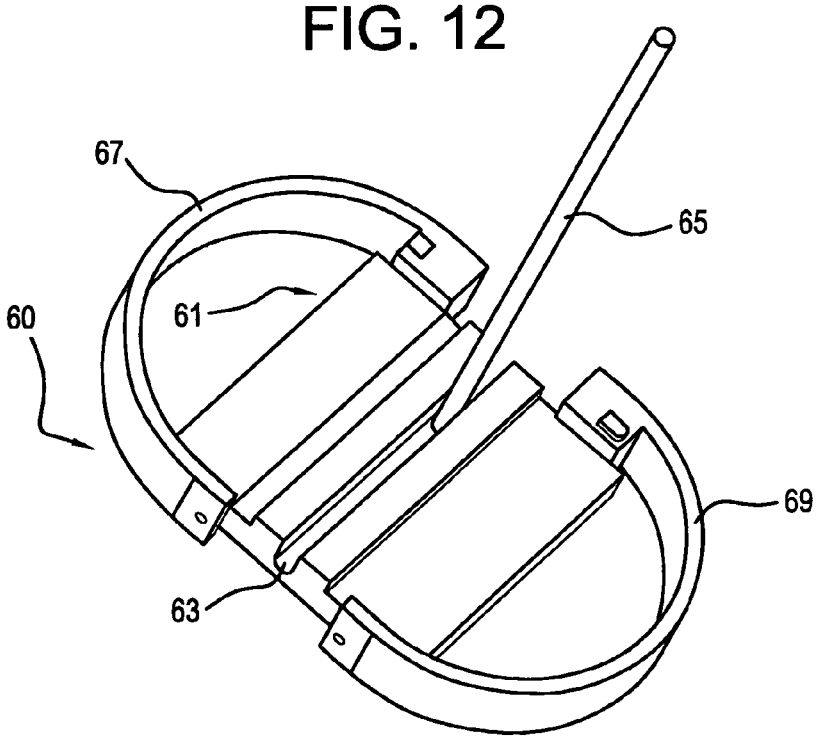
FIG. 12 shows a perspective view looking from above a second embodiment of the present invention.
Figure 13:
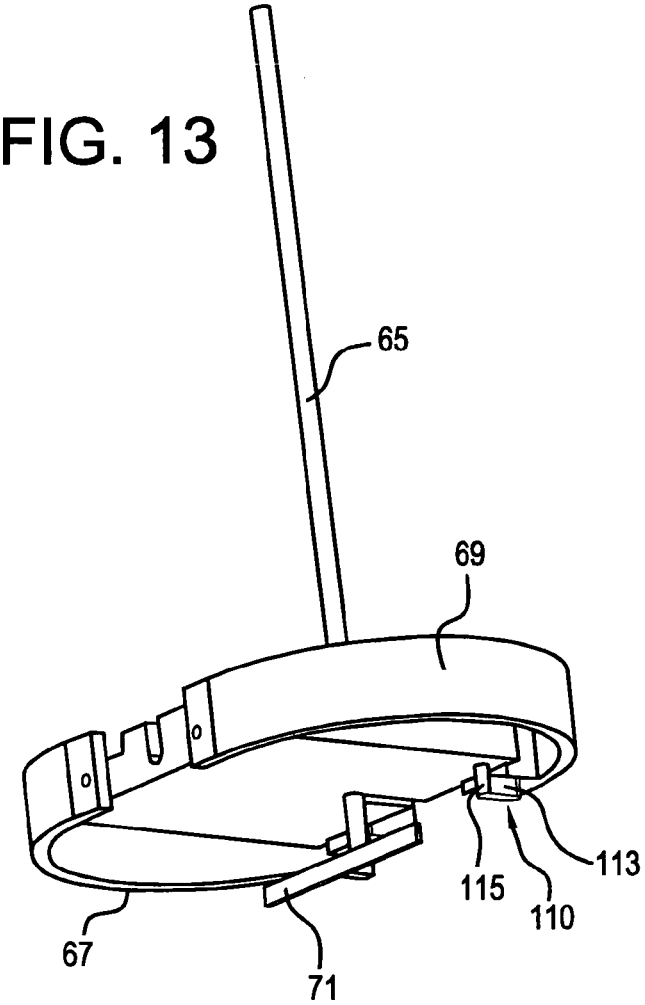
FIG. 13 shows a further perspective view looking from below the embodiment of FIG. 12.
Figure 14:
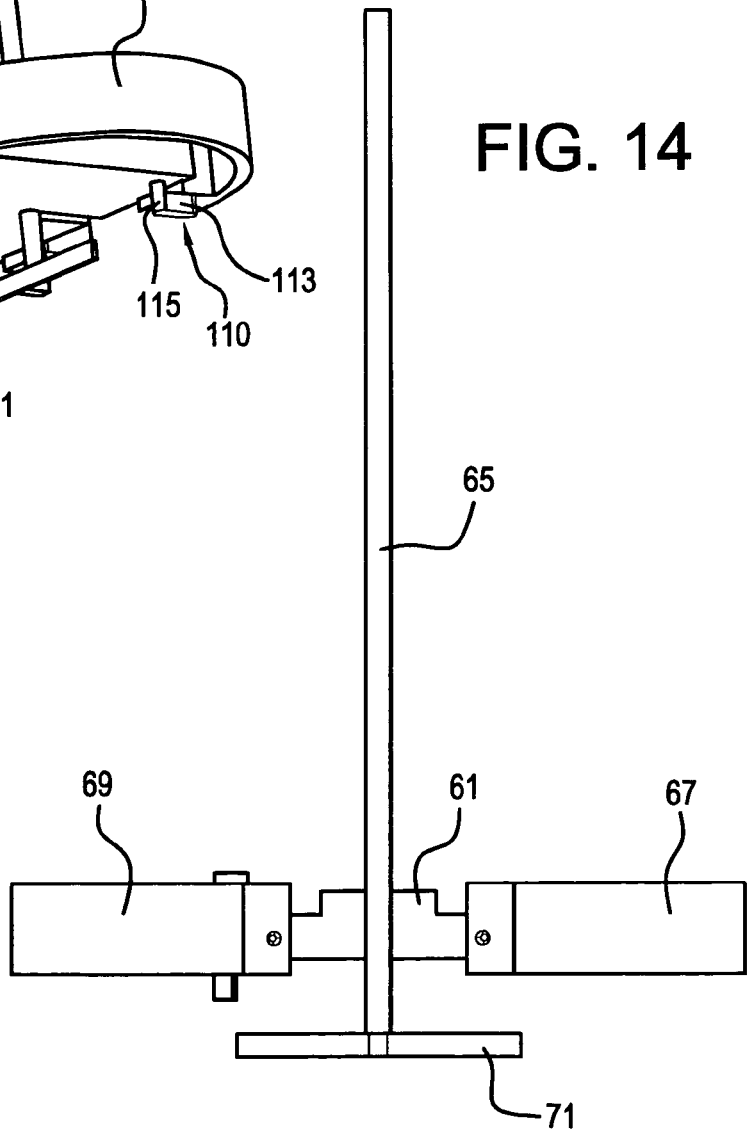
FIG. 14 shows a rear view of the embodiment of FIG. 12.
Figure 22:
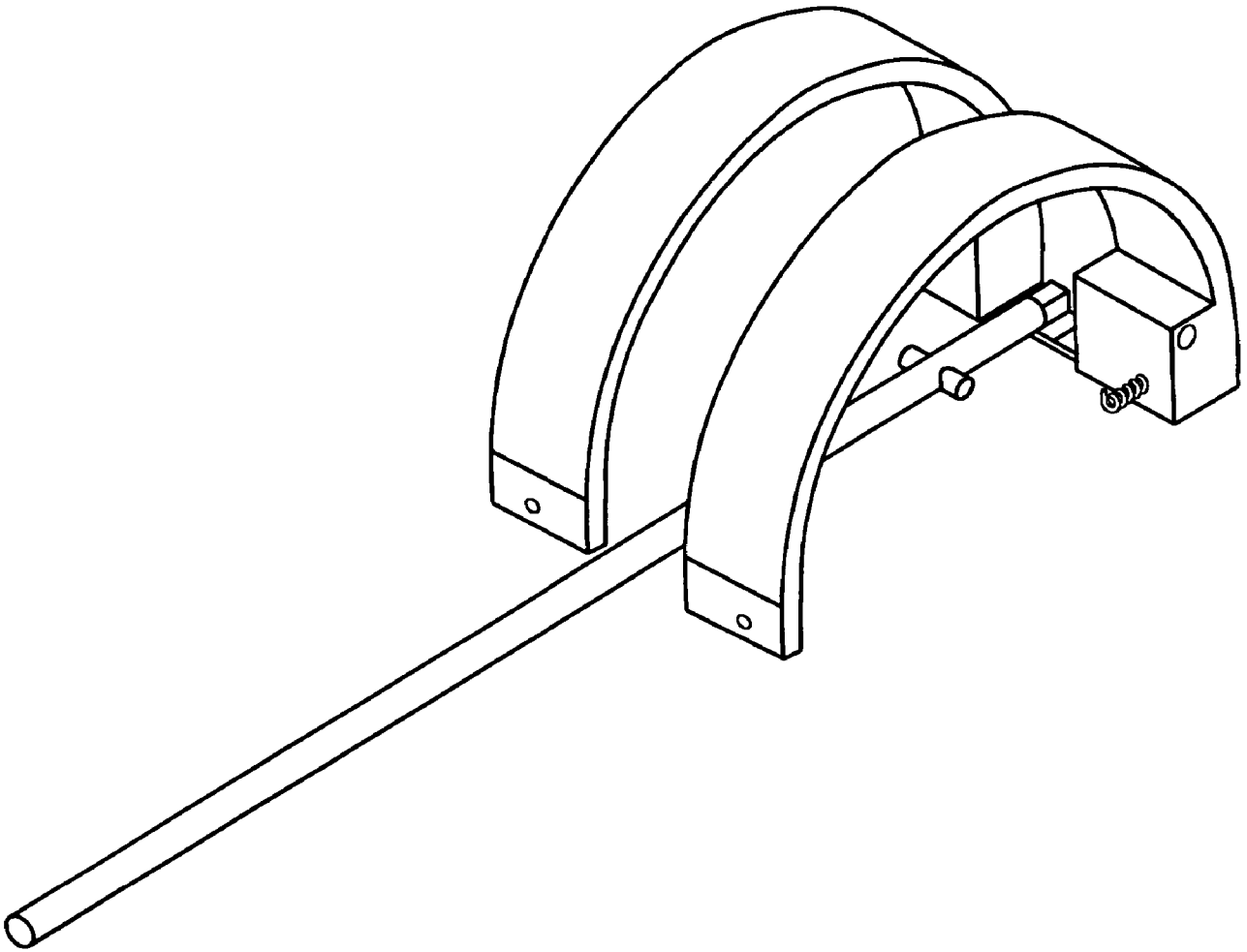
FIG. 22 shows a perspective view similar to that of FIG. 21, but including the earring post pivoted to a position locking the bails in parallel planes.
Figure 23:
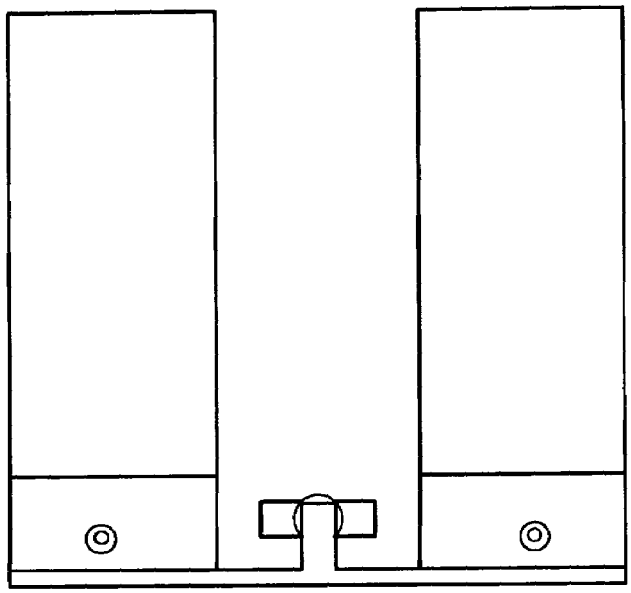
FIG. 23 shows a rear view of the parts and orientation thereof of FIG. 22.
Figure 24:
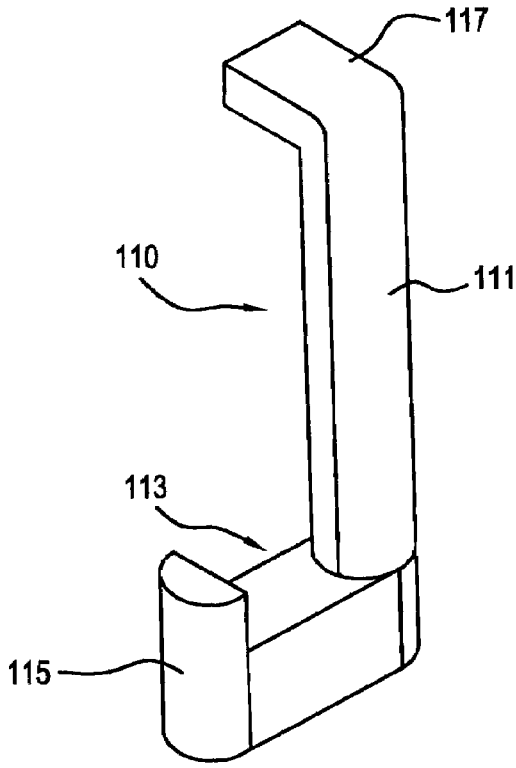
FIG. 24 shows a perspective view of a latch in accordance with the teachings of the present invention.

With reference, first, to FIGS. 12 and 13, a second embodiment of the present invention is generally designated by the reference numeral 60 and is seen to include a base 61 having a centrally disposed groove 63 and a post 65 pivotably mounted to the base as will be explained in greater detail hereinafter, and movable between the position shown in FIGS. 12–15, and the position shown in FIGS. 16 and 22–23. Hoops or bails 67 and 69 are shown in FIGS. 12–15 in the orientation at which they lie in a common plane and are positioned along with the orientation of the post 65 so that the inventive device 60 may be used as an earring in the manner described hereinabove with reference to FIGS. 1–11.

Figure 16:
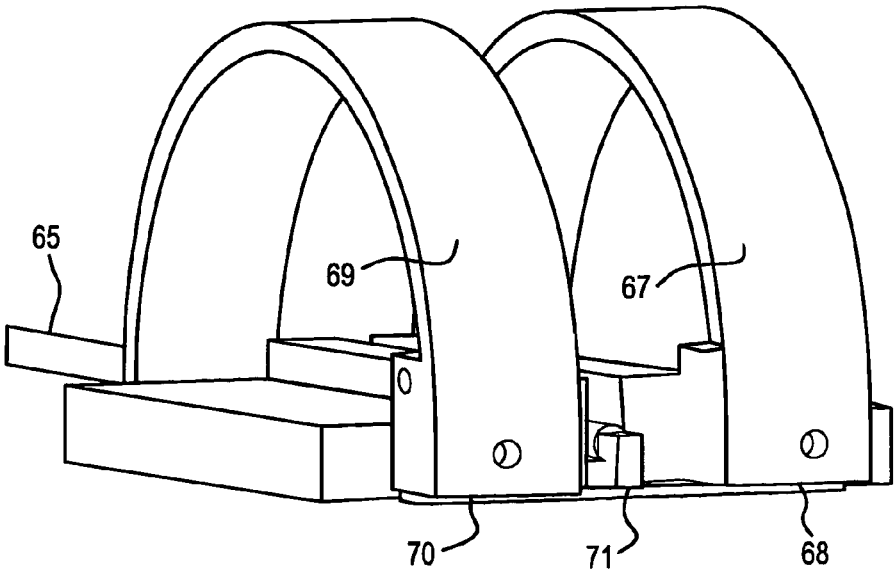
FIG. 16 shows a rear perspective view of the embodiment of FIG. 12.

As understood from a comparison of FIGS. 12 and 16, in the orientation shown in FIG. 16, the post 65 lies within the groove 63.

As seen in FIG. 13, the post 65 has a cross-member 71 giving the post 65 a T-shaped end. This is also shown with reference to FIG. 14. As should be understood with particular reference to FIG. 16, when the post is in a position pivoted 90 degrees from its position shown in FIGS. 12–13, the cross-member 71 underlies undersurfaces 68 and 70 of the hoops or bails 67 and 69, respectively, to retain them in the orientation shown in FIG. 16. As evident from comparison, for example, of FIGS. 12 and 16, the hoops or bails 67, 69 are pivotable from the position shown in FIG. 12 in which they lie in a common plane to the position shown in FIG. 16 in which they lie in parallel planes. One difference between the embodiment of FIGS. 1–11 and the embodiment of FIGS. 12–24 is that in the embodiment of FIGS. 12–24, the hoops or bails 67, 69 are spring biased toward the position best seen in FIG. 16.

Figure 17:
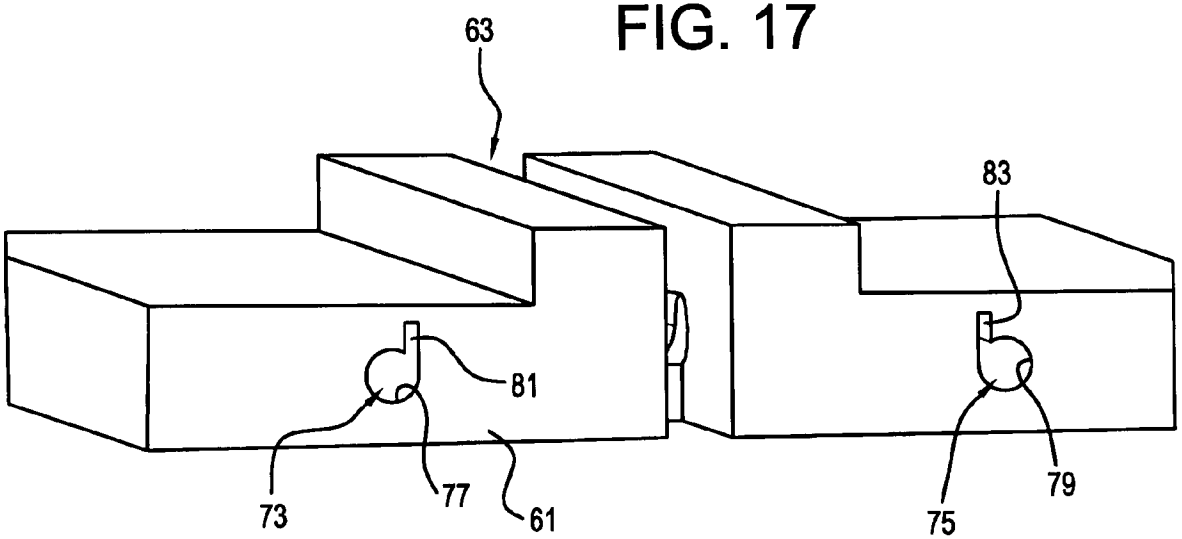
FIG. 17 shows a perspective view of the base of the embodiment of FIG. 12 with other parts removed to show detail.
Figure 18:
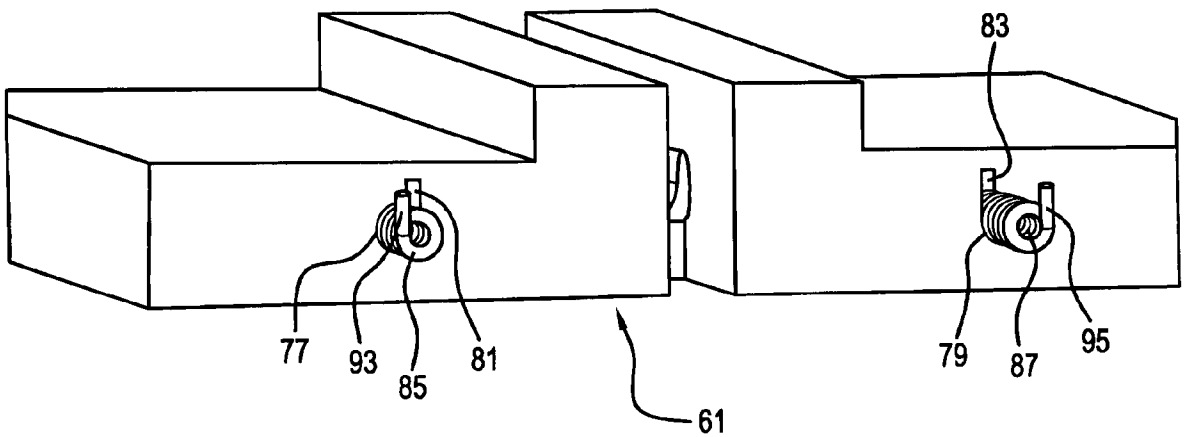
FIG. 18 shows a perspective view similar to that of FIG. 17, but showing the manner of mounting of the torsion springs thereof.
Figure 19:
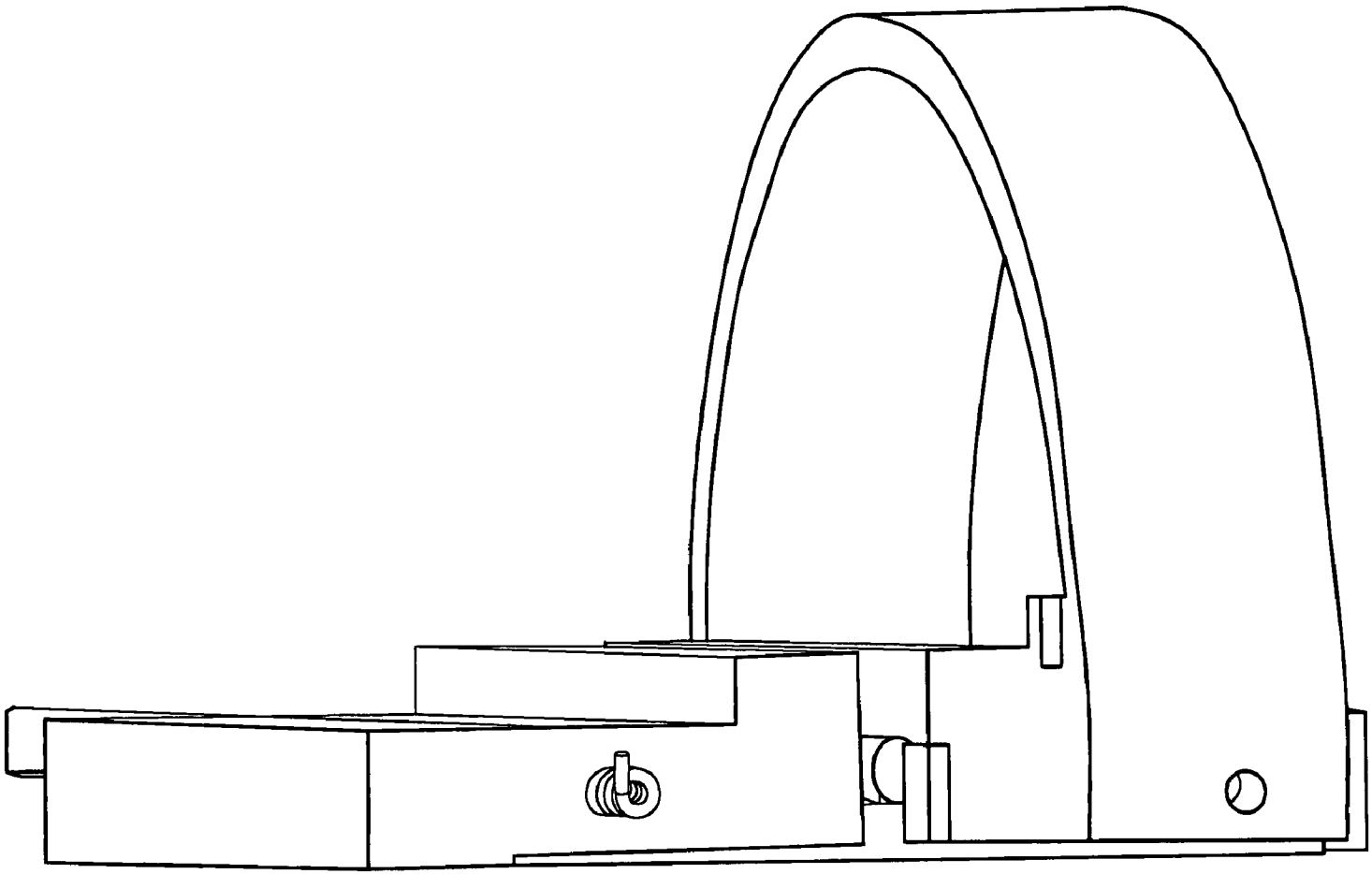
FIG. 19 shows a further perspective view of the base with one bail removed to show detail.
Figure 21:
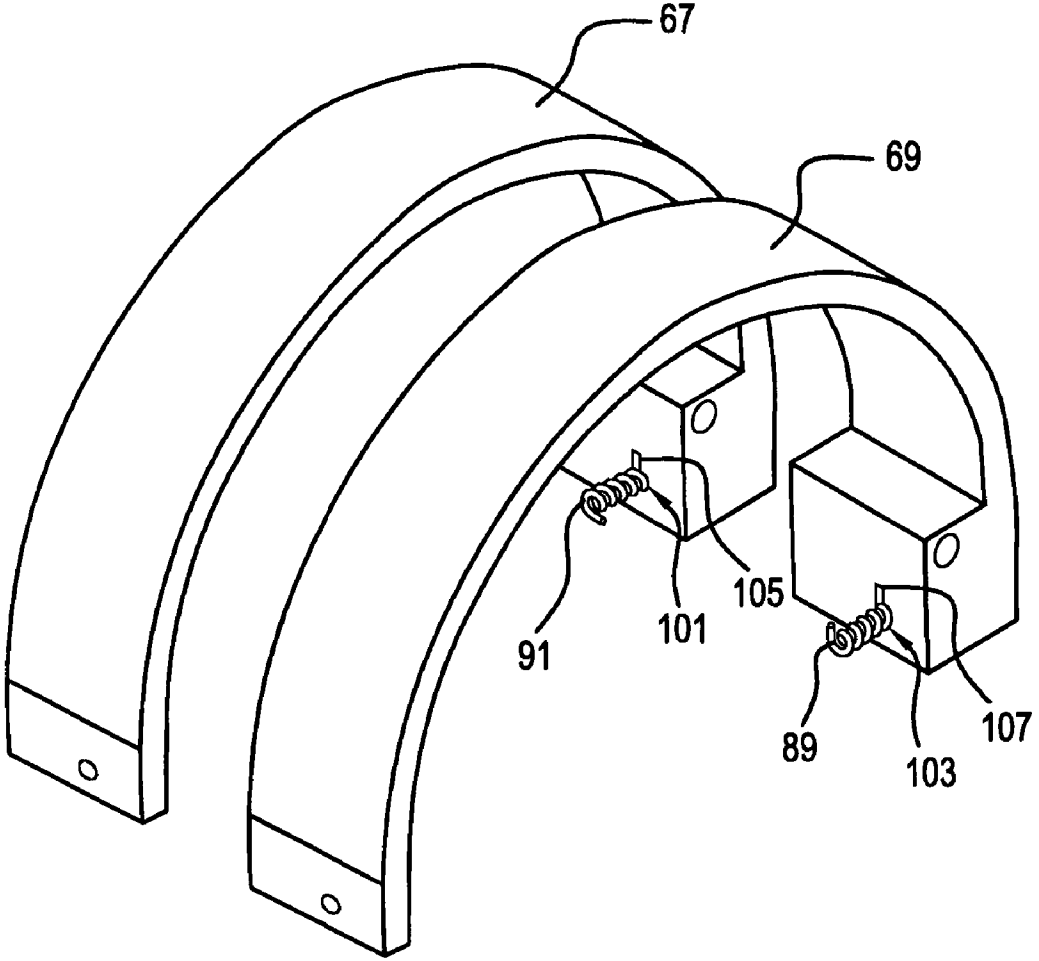
FIG. 21 shows a perspective view of two bails side-by-side separated from the base to show detail.

In this regard, reference is made to FIG. 17 which shows the base 61 with its groove 63. Also shown are passageways 73 and 75 extending into the base, with the passageways including respective cylindrical portions 77 and 79 connected to tangential extensions 81 and 83, respectively. As shown in FIG. 18, springs 85 and 87 are received within the cylindrical passageways 77 and 79, respectively, and the springs 85 and 87 have tangs (not shown) received in the respective tangential portions 81 and 83. These tangs designated by the reference numerals 89 and 91 are shown in FIG. 21. The purpose for the tangs 89 and 91 as received in the tangential portions 81 and 83 is to preclude rotation of the springs 85 and 87 with respect to the base 61.

As shown in FIG. 18, the spring 85 has a tang 93, and the spring 87 has a tang 95. As seen in FIG. 21, the hoops or bails 67 and 69 have passageways receiving the ends of the springs that are shown in FIG. 18. Those passageways are generally designated by the reference numerals 101 and 103 in FIG. 21, and have a similar configuration as the passageways 73, 75, best seen in FIG. 17. As seen in FIG. 21, the passageways 101 and 103 have tangential portions 105 and 107, respectively, that receive the tangs 93 and 95 of the springs 85 and 87, respectively. Therefore, the tangs 93 and 95 preclude the springs 85 and 87 from rotating with respect to the hoops or bails 67 and 69.

As this embodiment of the present invention is devised, when the hoops or bails 67 and 69 are in the position shown in FIG. 16, the springs 85 and 87 are relaxed and provide no rotative biasing force to the hoops or bails 67, 69. When the hoops or bails 67, 69 are pivoted to the orientation shown, for example, in FIG. 12, through interaction of the tangs and tangential portions, a force is imparted to the springs 85, 87 that causes a restoring force to be created that biases the hoops or bails 67, 69 toward the orientation thereof shown in FIG. 16.

Thus, in order to retain the hoops or bails 67, 69 in the position shown in FIGS. 12 and 13 until such time as it is desired to cause them to move to the position shown in FIG. 16, a latch means or latching mechanism is provided. In this regard, reference is first made to FIG. 24 which depicts a latch 110 that includes an elongated shaft 111, a catch 113 including an upwardly extending lip 115 and an actuating handle 117. With this description in mind, reference is now made to FIG. 20 which shows the hoop 69, the spring 85, and latch means comprising the latch 110 with its handle 117 and catch 113 clearly visible along with the upstanding portion 115.

Figure 15:
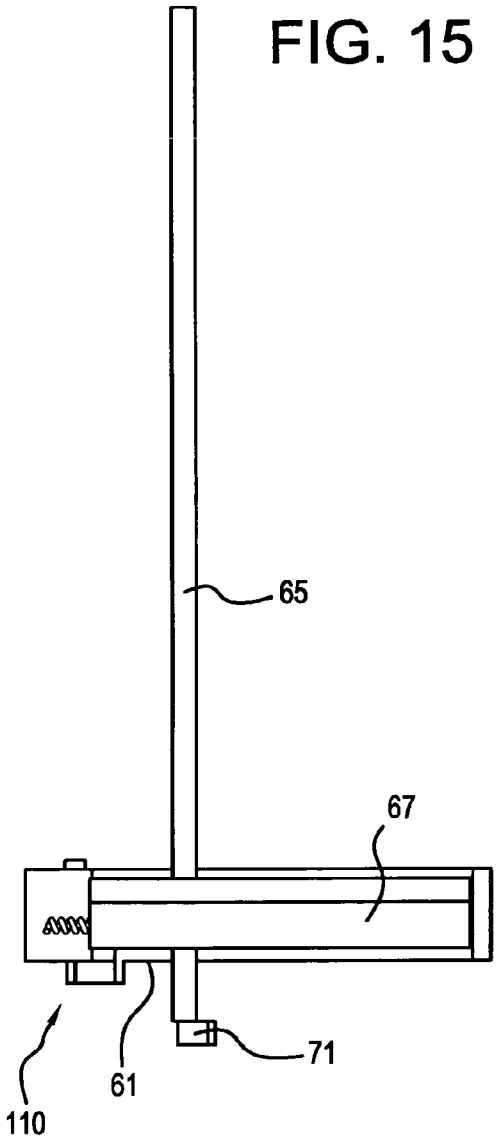
FIG. 15 shows a side view of the embodiment of FIG. 12.
Figure 20:
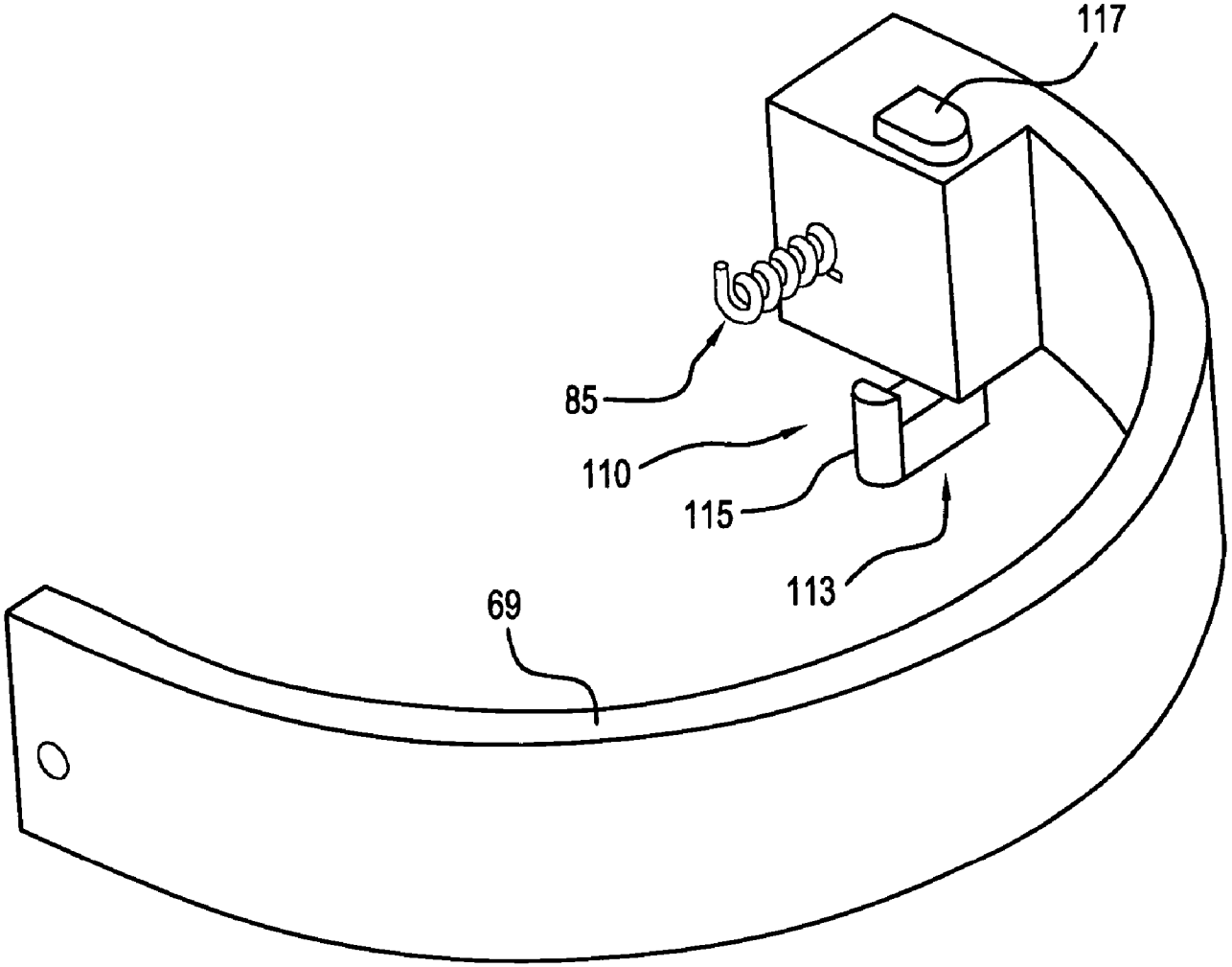
FIG. 20 shows a perspective view of a bail with its spring and latch.

Now, reference is made to FIG. 15 which shows the latch 110 in the same orientation as shown in FIG. 20, but underlying the base 61 to retain the hoop or bail 67 in a position in which it lies in a common plane with the hoop or bail 69. This structure is also shown with reference to FIG. 13.

As should be understood, when it is desired to release the latches 110 and permit the hoops or bails 67, 69 to pivot to the position best seen in FIG. 16 at which they lie in parallel planes, the handle 117 is pivoted 90 degrees in the counter-clockwise direction in the view of FIG. 20 which causes the catch 113, 115 to rotate away from the base 61, thereby permitting the spring 85 restoring force to pivot the bail 69 to the position shown in FIG. 16. While the drawing figures only show a latch 110 associated with the hoop or bail 69, this was done only for ease of understanding to avoid a multiplicity of components shown in the figures. It should be understood that each hoop or bail includes its own latch that are independently operable but typically operated together or one after the other to cause the hoops or bails 67, 69 to pivot to the position and orientation shown in FIG. 16 at which they lie in parallel planes.

In that position, once the hoops or bails 67, 69 arrive at the position shown in FIG. 16, the post 65 is pivoted from the position shown in FIG. 13 to the position shown in FIG. 16 so that the cross-member 71 underlies the undersurfaces 68, 70 of the hoops or bails 67, 69 to retain them in the position shown in FIG. 16. When it is desired to move the hoops or bails 67, 69 back to the orientation shown in FIGS. 12–15, first the post 65 is pivoted to the position shown in FIGS. 12–15. Thereafter, the hoops or bails 67, 69 are manually pivoted to the orientation shown in FIGS. 12–15, and thereafter the latches 110 are pivoted 90 degrees to the orientation shown in FIGS. 13 and 20 at which they underlie the base 61 to lock the positions of the hoops or bails 67, 69.

The mechanisms shown in the embodiment of FIGS. 12–24 provide an easier and more positive conversion from earring to pendant. Of course, the embodiment of FIGS. 1–11 is significantly more simple in design and structure.

As such, an invention has been disclosed in terms of preferred embodiments thereof which fulfill each and every one of the objects of the present invention as set forth hereinabove and provide a new and useful convertible jewelry mounting of great novelty and utility.

Of course, various changes, modifications and alterations in the teachings of the present invention may be contemplated by those of ordinary skill in the art without departing from the intended spirit and scope thereof.

As such, it is intended that the present invention only be limited by the terms of the appended claims.

The invention claimed is:

1. A convertible jewelry mounting, comprising:

a) a base connectable to an ornament;

b) said base having an ear post pivotably mounted thereon, said ear post pivotable between a first position at which it may be detachably attached to an ear, and a second position remote from said first position;

c) a hoop pivotably mounted on said base, said hoop pivotable between a first position at which it may comprise a bail adapted to receive a chain, and a second position remote from said first position;

d) whereby, in use, when said hoop is moved to said first position thereof, said ear post may be moved to said second position thereof;

e) said ear post having a first tab and said hoop having a second tab, said first tab overlying said second tab when said ear post is in said second position thereof and said hoop is in said first position thereof to releasably retain said hoop in said first position thereof.

2. The mounting of claim 1, wherein said base has a front surface and a rear surface, said ornament connectable to said front surface.

3. The mounting of claim 1, wherein said first and second positions of said ear post are approximately perpendicular.

4. The mounting of claim 1, wherein said first and second positions of said hoop are approximately perpendicular.

5. The mounting of claim 4, wherein said hoop is biased in a direction of movement from said second position toward said first position.

6. The mounting of claim 5, further including latch means for latching said hoop in said second position.

7. The mounting of claim 1, wherein said hoop comprises a first hoop, said mounting comprising a second hoop pivotably mounted on said base, said second hoop pivotable between a first position at which it may comprise a bail adapted to receive a chain, and a second position remote from said first position.

8. The mounting of claim 7, wherein in said respective first positions of said hoops, said hoops lie in parallel planes.

9. The mounting of claim 7, wherein in said respective second positions of said hoops, said hoops lie in a common plane.

10. The mounting of claim 8, wherein in said respective second positions of said hoops, said hoops lie in a common plane.

11. The mounting of claim 7, wherein said ear post has a cross-member at one end thereof, whereby in said second position of said ear post and first position of said hoops, said cross-member underlies undersurfaces of said hoops to retain them in their first position.

12. The mounting of claim 7, wherein each hoop is biased in a direction of movement from said second position toward said first position.

13. The mounting of claim 12, further including latch means for latching each hoop in said second position.

14. The mounting of claim 7, wherein said ear post pivots in a direction perpendicular to directions of pivoting of said hoops.

15. The mounting of claim 14, wherein each hoop includes a said second tab.

16. The mounting of claim 15, wherein in said first positions of said hoops and said second position of said ear post, said first tab overlies said second tabs.

17. The mounting of claim 16, wherein in said second position of said ear post, an end of said ear post is received in a slot to retain said ear post in said second position.

18. The mounting of claim 17, wherein said slot is located on an ornament connected to said base.

19. The mounting of claim 1, wherein in said second position of said ear post, an end of said ear post is received in a slot to retain said ear post in said second position.

20. The mounting of claim 19, wherein said slot is located on an ornament connected to said base.

21. A convertible jewelry mounting, comprising:

a) a base having a front surface connectable to an ornament;

b) said base having an ear post pivotably mounted on a rear surface thereof, said ear post pivotable between a first position at which it may be detachably attached to an ear, and a second position perpendicular to said first position;

c) first and second hoops pivotably mounted on sides of said base, each of said hoops pivotable between a first position at which it may comprise a bail adapted to receive a chain, and a second position perpendicular to said first position, said hoops biased to move toward said first position;

d) whereby, in use, when said hoops are moved to their first position, said ear post may be moved to said second position thereof; and e) releasable latch means for retaining said hoops in said second position thereof;

f)a first tab on said ear post and second tabs on said hoops, said first tab overlying said second tabs when said ear post is in said second position thereof and said hoops are in said first position thereof to releasably retain said hoops in said first position thereof.

22. The mounting of claim 21, wherein in respective said first positions of said hoops, said hoops lie in parallel planes.

23. The mounting of claim 22, wherein in respective said second positions of said hoops, said hoops lie in a common plane.

24. The mounting of claim 23, wherein said ear post includes a cross-member at one end thereof, whereby in said second position of said ear post and first position of said hoops, said cross-member underlies undersurfaces of said hoops to retain them in their first position.

25. The mounting of claim 21, wherein said ear post pivots in a direction perpendicular to directions of pivoting of said hoops.

26. The mounting of claim 25, wherein in said second position of said ear post, an end of said ear post is received in a slot to retain said ear post in said second position.

27. A convertible jewelry mounting, comprising:

a) a base connectable to an ornament;

b) said base having an ear post pivotably mounted thereon, said ear post pivotable between a first position at which it may be detachably attached to an ear, and a second position remote from said first position;

c) a hoop pivotably mounted on said base, said hoop pivotable between a first position at which it may comprise a bail adapted to receive a chain, and a second position remote from said first position;

d) whereby, in use, when said hoop is moved to said first position thereof, said ear post may be moved to said second position thereof;

e) said ear post having a cross-member at one end thereof, whereby in said second position of said ear post and first position of said hoop, said cross-member underlies an undersurface of said hoop to retain said hoop in said first position thereof.

28. The mounting of claim 27, wherein said hoop comprises a first hoop, said mounting comprising a second hoop pivotably mounted on said base, said second hoop pivotable between a first position at which it may comprise a bail adapted to receive a chain, and a second position remote from said first position, whereby in said second position of said ear post, said cross-member underlies undersurfaces of said first and second hoops to retain them in their first position.

* * * * *